US005941696A

United States Patent [19]

Fenstermacher et al.

[11] Patent Number: 5,941,696

[45] Date of Patent: Aug. 24, 1999

[54] PERISTALTIC PUMP

[75] Inventors: V. Hayes Fenstermacher, Raleigh; Kenneth Hall, Pinehurst, both of N.C.

[73] Assignee: Embrex, Inc., Research Triangle Park, N.C.

[21] Appl. No.: 08/926,160

[22] Filed: Sep. 9, 1997

Related U.S. Application Data

[60] Provisional application No. 60/025,644, Sep. 10, 1996.

[51] Int. Cl.[6] ..... F04B 43/12

[52] U.S. Cl. ..... 417/477.6; 417/475

[58] Field of Search ..... 417/475, 477.6, 417/477.1, 477.3

[56] References Cited

U.S. PATENT DOCUMENTS

| | | | |
|---|---|---|---|
| 3,740,173 | 6/1973 | Natelson | 417/475 |
| 4,233,001 | 11/1980 | Schmid . | |
| 4,473,342 | 9/1984 | Iles . | |
| 4,522,570 | 6/1985 | Schartz . | |
| 4,604,038 | 8/1986 | Belew | 417/475 |
| 4,606,710 | 8/1986 | Maguire | 417/477.6 |
| 4,950,245 | 8/1990 | Brown et al. . | |
| 5,082,429 | 1/1992 | Soderquist et al. . | |
| 5,096,393 | 3/1992 | Van Steenderen et al. . | |
| 5,256,041 | 10/1993 | Tucker . | |

*Primary Examiner*—Timothy S. Thorpe
*Assistant Examiner*—Cheryl J. Tyler
*Attorney, Agent, or Firm*—Myers Bigel Sibley & Sajovec, P.A.

[57] ABSTRACT

A peristaltic pump for precision metering of small quantities of fluid through a plurality of flow lines has a plurality of flexible liquid transfer tubes disposed between a set of tube rollers and an arcuate backing plate. The tube rollers are mounted on a roller support which is rotated about a central axis and causes the tube rollers to roll successively along the tubes, compressing the tubes against the arcuate surface of the backing plate and causing the fluid contained within the tubes to flow progressively in the direction of roller movement. The tube rollers are individually gear driven and turn at a rate which provides a roller surface speed equal to the rate of movement along the tubes, thereby eliminating any frictional drag along the tubes. The flexible tubes are mounted on the pump housing under uniform controlled tension to assure that each tube dispenses fluid at an equal rate. The tube rollers orbit about and are in positive contact with a inner support roller which provides lateral support to the tube rollers and prevents any radial deflection of the tube rollers under the compressive forces exerted against the flexible tubes.

14 Claims, 6 Drawing Sheets

PERISTALTIC PUMP

This application claims the benefit of U.S. Provisional Application No. 60/025,644, filed Sep. 10, 1996.

FIELD OF THE INVENTION

This invention relates to a peristaltic pump, and more particularly to a precision industrial peristaltic pump for reliably metering small quantities of fluid through a plurality of flexible tubes over extended periods of operation.

BACKGROUND OF THE INVENTION

Peristaltic pumps have been widely used for medical and research applications where constant metering of fluids at relatively low flow rates is desired. The conventional peristaltic pump provides a circular array of rollers driven in a planetary motion against one or more flexible tubes to effect peristaltic pumping. In pumps which utilize an array of peristaltic tubes, special care must be taken to assure that all tubes deliver fluid at the same rate if this is desired. The rate of delivery is a function not only of the rate at which the rollers move along the tube, but also the inside and outside diameters of the tube, the compression characteristics, the force with which the roller compresses the tube and the tension of the tube within the pump. All these variables must be carefully and precisely controlled to assure consistent and uniform metering rates within and between the delivery tubes.

It is accordingly an object of the present invention to provide an improved peristaltic pump for the precision dose metering of fluids through a plurality of flexible flow lines. It is a further object of this invention to provide a precision peristaltic pump for industrial applications. It is a yet further object of this invention to provide a peristaltic pump in which a plurality of flexible flow lines may be conveniently installed, removed and exchanged in a uniform, consistent manner. These and other objects will be apparent to those skilled in the art in view of the following drawings and detailed description of the invention.

SUMMARY OF THE INVENTION

According to the present invention, there is provided a peristaltic metering pump which comprises a set of elongated tube rollers and a plurality of flexible liquid transfer tubes, the tubes being disposed between the tube rollers and an arcuate backing plate against which they are simultaneously compressed by at least one and preferably three rollers. The tube rollers are equally spaced and circumferentially disposed about a central axis and mounted in roller supports rotatable about said central axis whereby said rollers are caused to orbit around the central axis. The roller supports are secured to a driven shaft which is supported by stationary end plates and has one end connected to a drive motor through coupling means. Each tube roller has at least one end in contact with a stationary outer race in at least one end plate which causes each tube roller to rotate about its own axis while orbiting the central axis. The rotation thereby imparted to each tube roller causes the roller to traverse the tubes in a positive manner without slippage or frictional drag on the tubes. In a preferred embodiment, the stationary outer race is a ring gear incorporated in the end plate proximal to the drive motor, and each tube has a mating gear engaging the ring gear to provide positive tube drive.

Disposed over the drive shaft on the central axis is a support roller having an outer diameter sufficient to place the support roller in positive surface contact with each tube roller as it orbits around the central axis. Preferably, a single support roller extends the full length of the tube rollers although two or more shorter support rollers may be used. The support roller or rollers provide lateral support to the tube rollers, preventing deflection of the tube rollers under the radial forces exerted against the rollers by the flexible tubes being compressed against the arcuate backing plate. In this manner, variations in compressive forces exerted against the flexible tubes over the length of the tube rollers and consequent variations in fluid delivery rate are eliminated or minimized.

The arcuate backing plate is secured at each end to the stationary end plates by pin means which permit the front of the backing plate to pivot away from the pump body in order to access the flexible tubes and tube rollers. The flexible tubes extend over the tube rollers and are secured in tube clamping means on the front and rear of the pump body. The flexible tubes are arranged in parallel with all the tubes under substantially the same tension to avoid any variations in tube diameter or compression with consequent variations in fluid delivery rate.

The flexible tubes are premounted in the tube clamping means using a mounting jig which permits each tube to be secured while in an extended but relaxed state. The spacing between the clamping means on the jig is preferably one percent to five percent less than the distance between the clamp mounting means on the pump body, whereby each tube is uniformly extended from one to five percent when mounted on the pump. This method of mounting the flexible tubes assures uniform tension and contributes to the uniform fluid delivery rates obtained with the pump of the present invention.

DETAILED DESCRIPTION OF THE INVENTION

Figure 1:
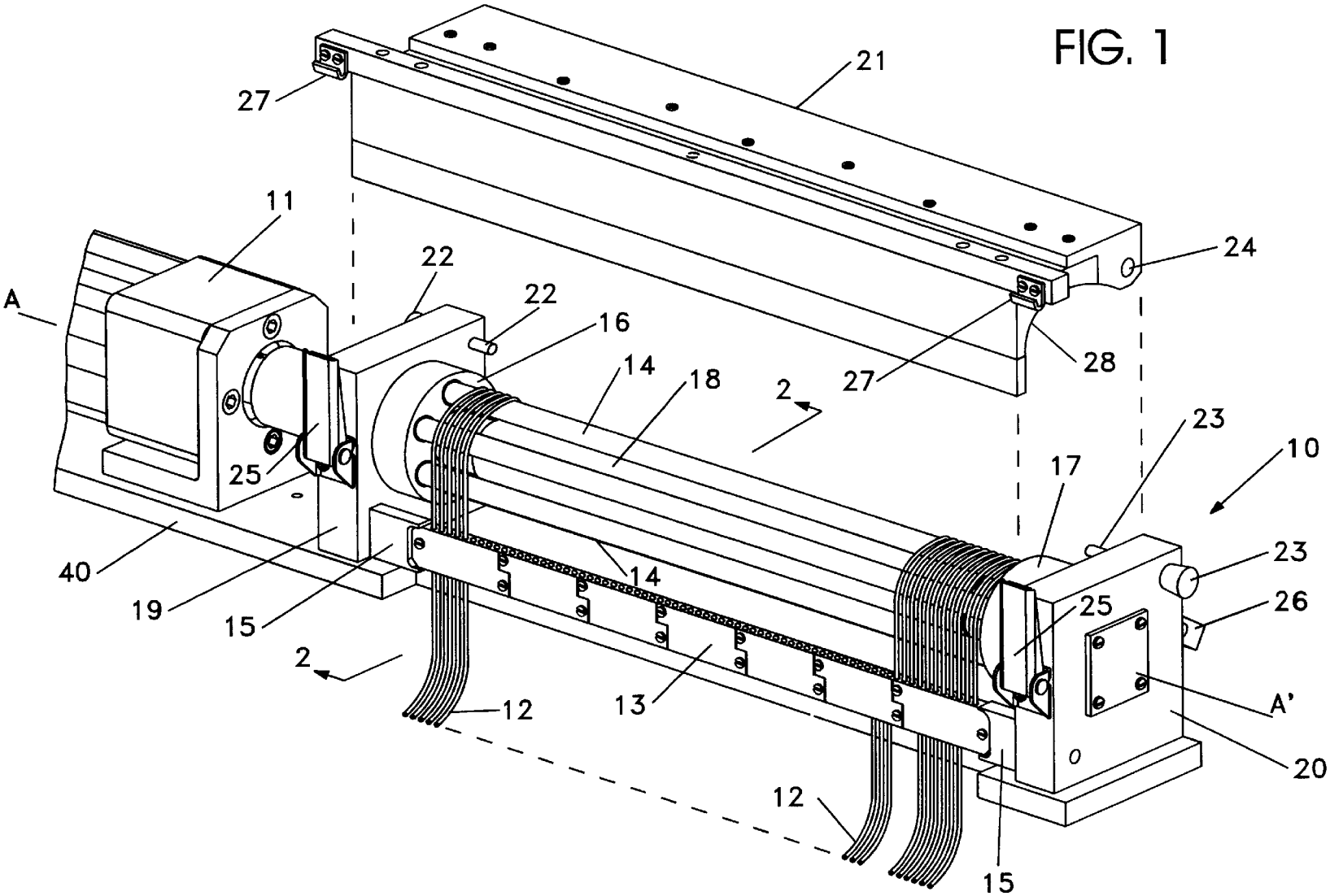
FIG. 1 is a front perspective view showing a pump of the present invention in operative association with a driving motor, with the backing plate of the pump elevated for clarity of illustration.

Referring now to FIG. 1, there is illustrated in front perspective view a peristaltic pump indicated generally at 10 mounted on base plate 40 in association with drive motor 11 and with a plurality of flexible tubes 12 mounted on the pump and extending from front tube clamping means 13 over a plurality of driven tube rollers 14 to rear tube clamping means (not shown). Tube clamping means 13 is secured to the front of the pump assembly by brackets 15 mounted on end plates 19 and 20. A corresponding tube clamping means is secured to the rear of the pump assembly by brackets mounted on end plates 19 and 20, one of which is partially visible in FIG. 1 as 26. Tube rollers 14 are rotatably mounted in roller supports 16 and 17 and each roller support is fixed to and rotated on a central drive shaft about longitudinal axis A–A' of the pump assembly. Centrally disposed along axis A–A' within the confines of the tube rollers is support roller 18 which is in positive surface contact with tube rollers 14 and provides lateral support along the length of the tube rollers to prevent radial deflection of the tube rollers between the roller supports at each end.

Arcuate backing plate indicated generally at 21 is shown in FIG. 1 in a detached raised position for clarity of illustration. Backing plate 21 is pivotally mounted to end plates 19 and 20 by means of pins 22 and 23 which engage pivot holes near the rear edge of the backing plate, one of which is visible in FIG. 1 as 24. The backing plate is pivotally mounted to the pump assembly to provide access to the tube rollers when mounting or removing the flexible tubes, and to permit the compressive forces against the tubes to be released when the pump is not in operation. During operation, the backing plate is securely clamped in position by means of swing clamps 25 mounted on end plates 19 and 20, and corresponding engaging hooks 27 mounted on the front edge of the backing plate. Flexible tubes 12 which overly tube rollers 14 are compressed by the tube rollers against arcuate surface 28 of the backing plate as will be more readily apparent in FIG. 2.

Figure 2:
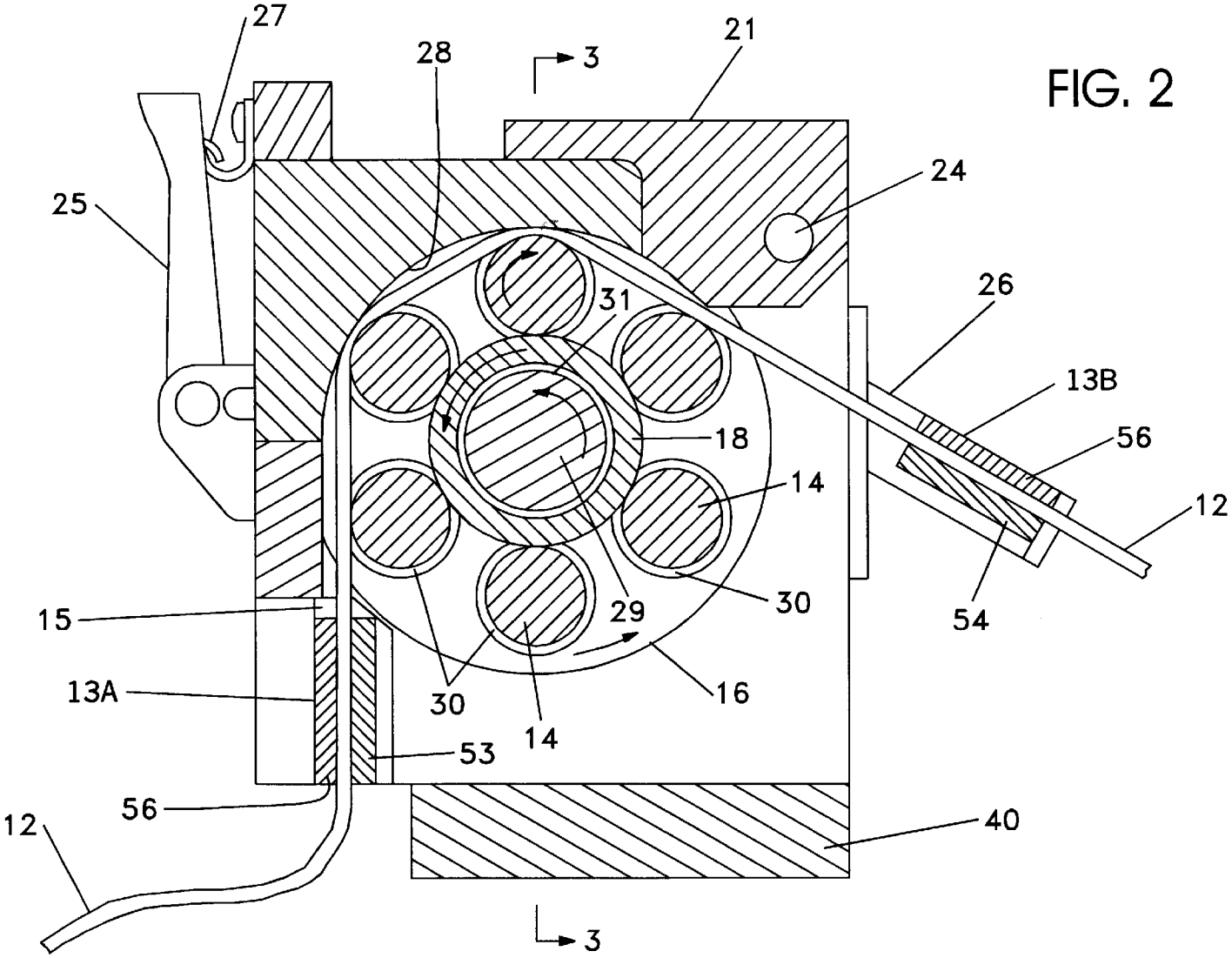
FIG. 2 is a transverse sectional view of the pump body taken generally along line 2—2 of FIG. 1.

FIG. 2 is a transverse sectional view of the pump assembly taken along line 2—2 of FIG. 1 with the backing plate locked in position for operation. Tube rollers 14 mounted in roller support 16 rotate in a counterclockwise direction around central drive shaft 29. Each tube roller is rotatably supported in roller support 16 by bearing means 30 which permit each tube roller 14 to rotate freely bout its own axis in a clockwise direction as the roller assembly rotates counterclockwise. Disposed between and in positive surface contact with tube rollers 14 is support roller 18 which is rotatably mounted on central drive shaft 29 through bearing means 31 which allow support roller 18 to rotate freely in a counterclockwise direction as driven by contact with tube rollers 14 as the roller assembly rotates about the central axis. Flexible tubing 12 is secured on either side of the pump assembly by clamping means 13A and 13B which are described below in greater detail.

As illustrated in FIG. 2, flexible tubing 12 is compressed by rollers 14 against arcuate surface 28 of backing plate 21. The length of arcuate surface 28 is such that tube 12 is compressed by at least one and preferably by at least two tube rollers at all times. The arcuate surface 28 of the backing plate is spaced from the surface of tube rollers 14 by a distance which allows the tube rollers to compress and securely close the lumen of flexible tube 12 without unduly crushing the tube. In one example, in a pump assembly utilizing flexible tubes having a wall thickness of about 0.035 inches, the arcuate surface of the backing plate is spaced about 0.050 inches from the surface of the tube rollers, whereby the flexible tube is compressed about 0.020 inches beyond twice the wall thickness and incipient closure.

Figure 3:
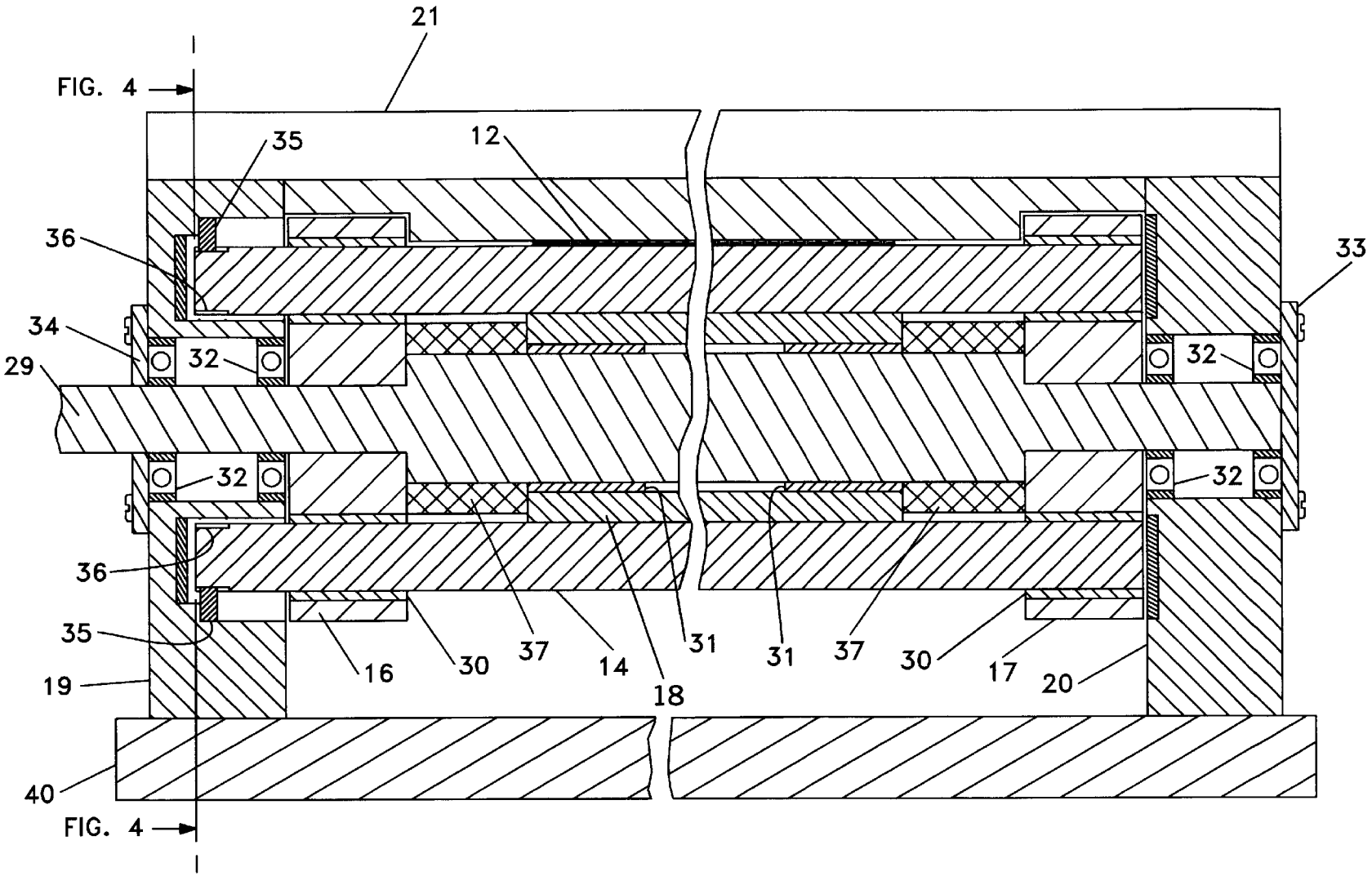
FIG. 3 is a longitudinal sectional view of the pump body taken generally along line 3—3 of FIG. 2.

Referring now to FIG. 3, there is illustrated a partial longitudinal section view taken generally along line 3—3 of FIG. 2 showing further details of the pump assembly. Central drive shaft 29 is supported in end plates 19 and 20 by bearings 32 enclosed in the bearing housing by cover plates 33 and 34. Support roller 18 is rotatably mounted on central shaft 29 through bearing means 31 located near the ends of the support rollers. If more than one support roller is used, each roller is supported by at least a pair of bearings. If a single support roller is used in a particularly wide pump assembly, internal bearings may be used to provide additional support. The tube roller bearings 30 and support roller bearings 31 are preferably needle bearings, while bearings 32 for the central drive shaft are preferably ball or roller bearings. As illustrated in FIG. 3, plastic spacer rings 37 are provided at each end of the idler roller.

The support roller must be precisely machined for concentricity about the central drive shaft to assure smooth operation and constant, uniform contact with the tube rollers. The diameter of the support roller must be sufficient to assure firm contact with the tube rollers to assure that the support roller rotates consistently with the tube rollers. If contact between the support roller and the tube rollers is too light, slippage may occur, while if the contact is unduly firm, excessive wear of the bearings and roller surfaces will be evident. While optimum dimensions will vary according to machine tolerances and craftsmanship, an interference fit between the support roll and tube rollers of between about 0.003 inches and 0.004 inches has been employed with good results. In addition, the surfaces of the support roller and tube rollers are preferably hardened by plating or heat treating to minimize wear inherent in metal-to-metal rolling contact.

Roller supports 16 and 17 are fixedly secured to central drive shaft 29 and rotate with it. Tube rollers 14 are rotatably supported in roller supports 16 and 17 by bearing means 30. End plate 19 is channeled to receive the proximal ends of tube rollers 14 extending through roller support 16, and is provided with ring gear 35 which engages mating gear teeth 36 on the end of each tube roller 14, thereby providing each tube roller with a positive rotational drive as roller supports 16 and 17 rotate with drive shaft 29 about central axis A–A'.

Figure 4:
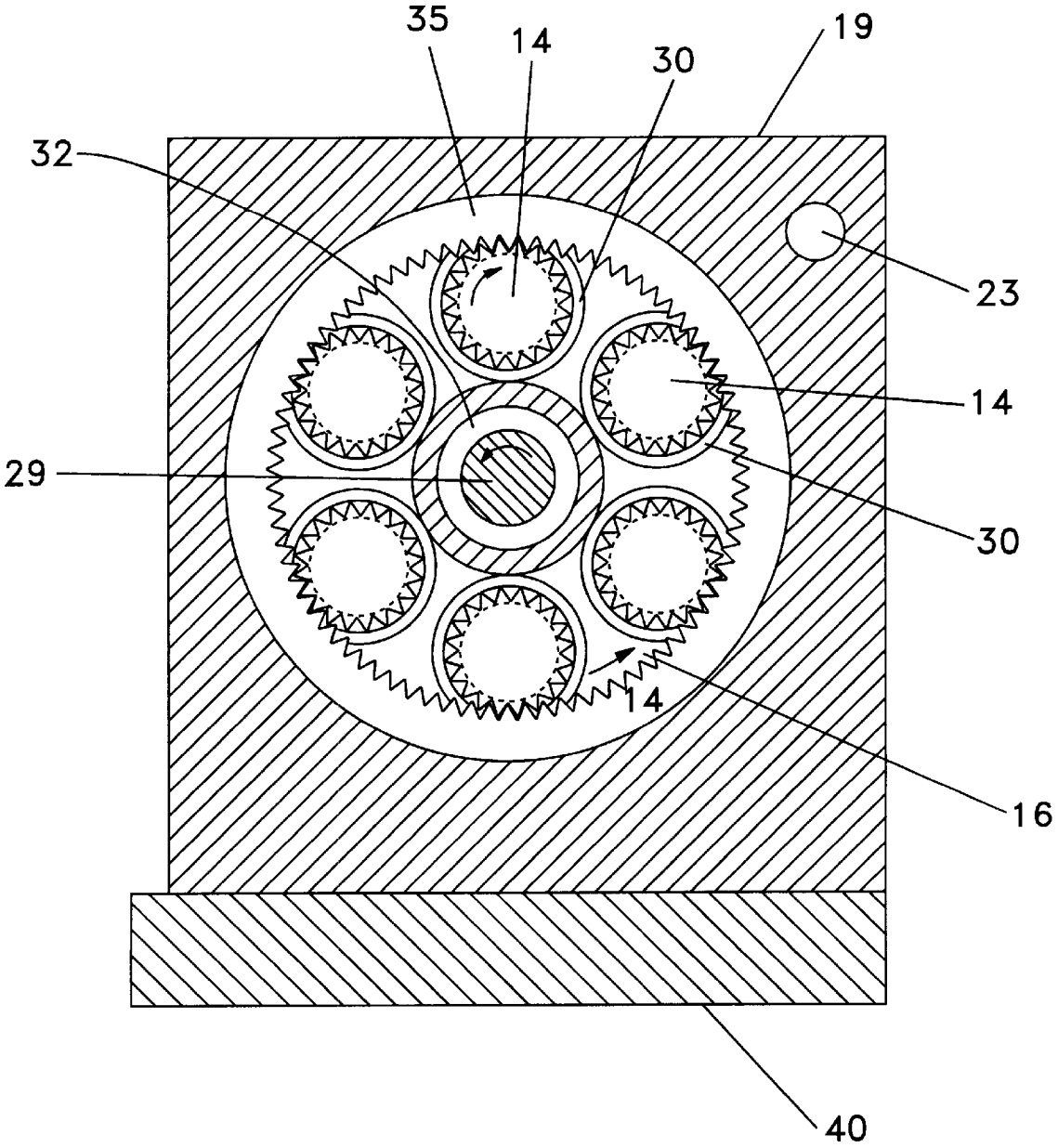
FIG. 4 is a transverse sectional view of the pump body taken generally along line 4—4 of FIG. 3.

The spacial relationship of the tube rollers and the ring gear is more readily apparent from FIG. 4 which is a transverse cross-sectional view through end plate 19 generally along lines 4—4 of FIG. 3 showing the geared ends of tube rollers 14. The counterclockwise direction of rotation of central drive shaft 29 and roller support 16, which rotate as a single unit, and the resulting clockwise direction of rotation of the tube rollers 14 are indicated by the respective arrows.

Figure 5:
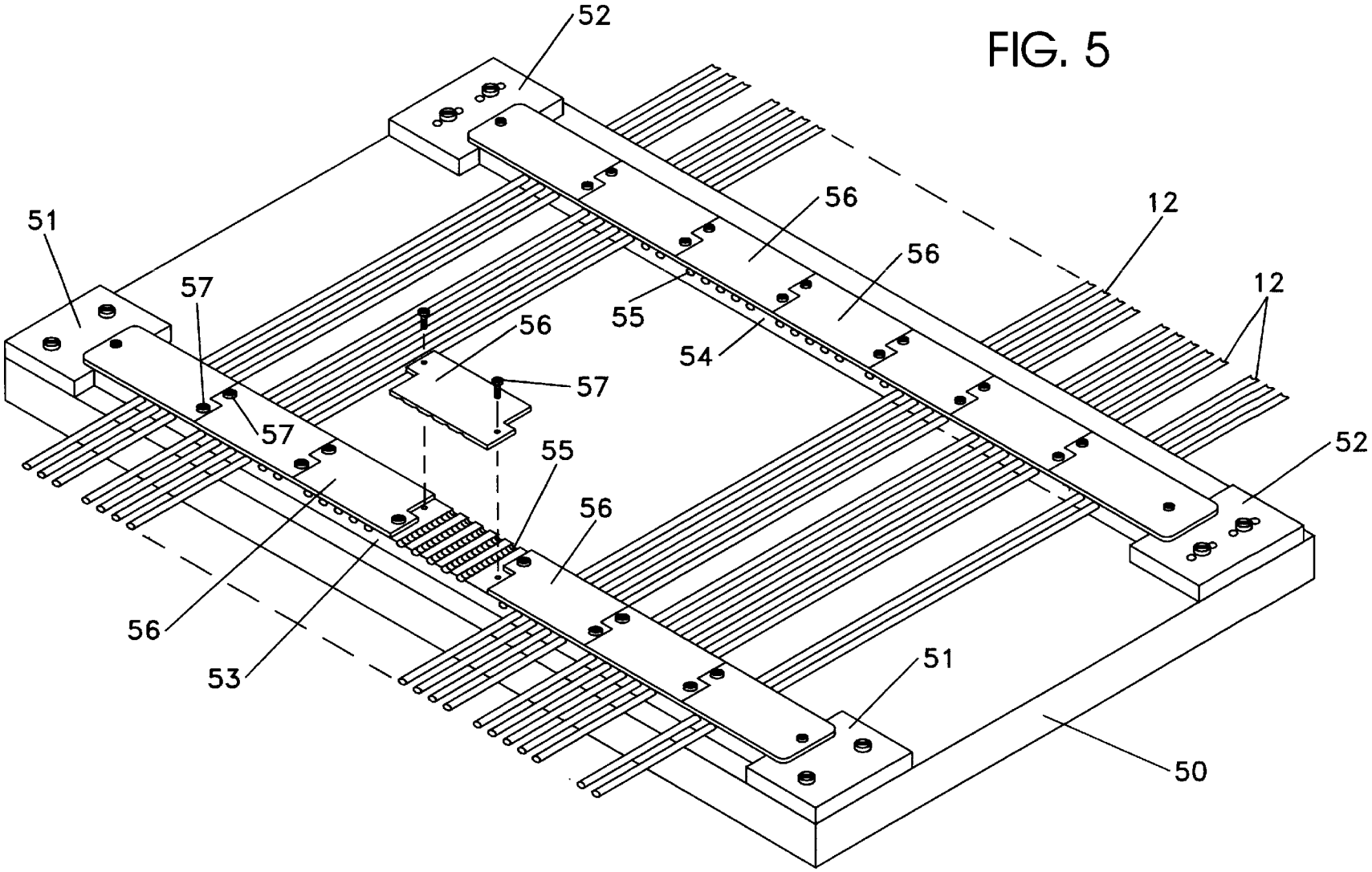
FIG. 5 is a front perspective view showing the tube mounting jig for use with the pump of the present invention.

FIG. 5 illustrates the tube mounting jig which allows a plurality of tubes to be mounted on the pump of the present invention under uniform tension to assure uniform tube-to-tube delivery. The jig consists of base 50 provided with brackets 51 and 52 for securing tube clamping base plates 53 and 54. Each base plate is provided with a plurality of grooved channels 55 sized to receive flexible tubes 12. The distance between base plates 53 and 54 is adjustable by positioning brackets 52 closer or farther from brackets 51. The position of brackets 52 determines the degree of stretch and amount of tension which will be imparted to the flexible tubes when the tubes are mounted on the pump. Normally the brackets are positioned to provide a stretch of from about one to five percent when the tubes are mounted on the pump in order to impart some positive tension to the tubes without substantial reduction in diameter.

In mounting the flexible tubes to the tube clamping means, a plurality of tubes are positioned within channels 55 on one section of base plate 53 and a cover plate 56 as secured to the base plate by means of screws 57 to enclose the positioned flexible tubes. The flexible tubes are usually secured in groups of three to six corresponding to the number of channels included under each cover plate and the desired number of tubes. The full complement of flexible tubes is preferably secured to base plate 53 by beginning at one end and progressing across the width of the base plate, taking care to assure that each tube lies straight within the channel of the base plate and under the cover plate. Once all the tubes are secured to base plate 53, they are extended across the mounting jig and secured to base plate 54 following the same procedure as used for base plate 53, taking care to assure that the tubes are straight but are not under any substantial tension. Once all the tubes have been securely clamped to base plates 53 and 54, the base plates are removed from the jig and installed on the pump using brackets 15 and 26 as previously described.

Figure 6:
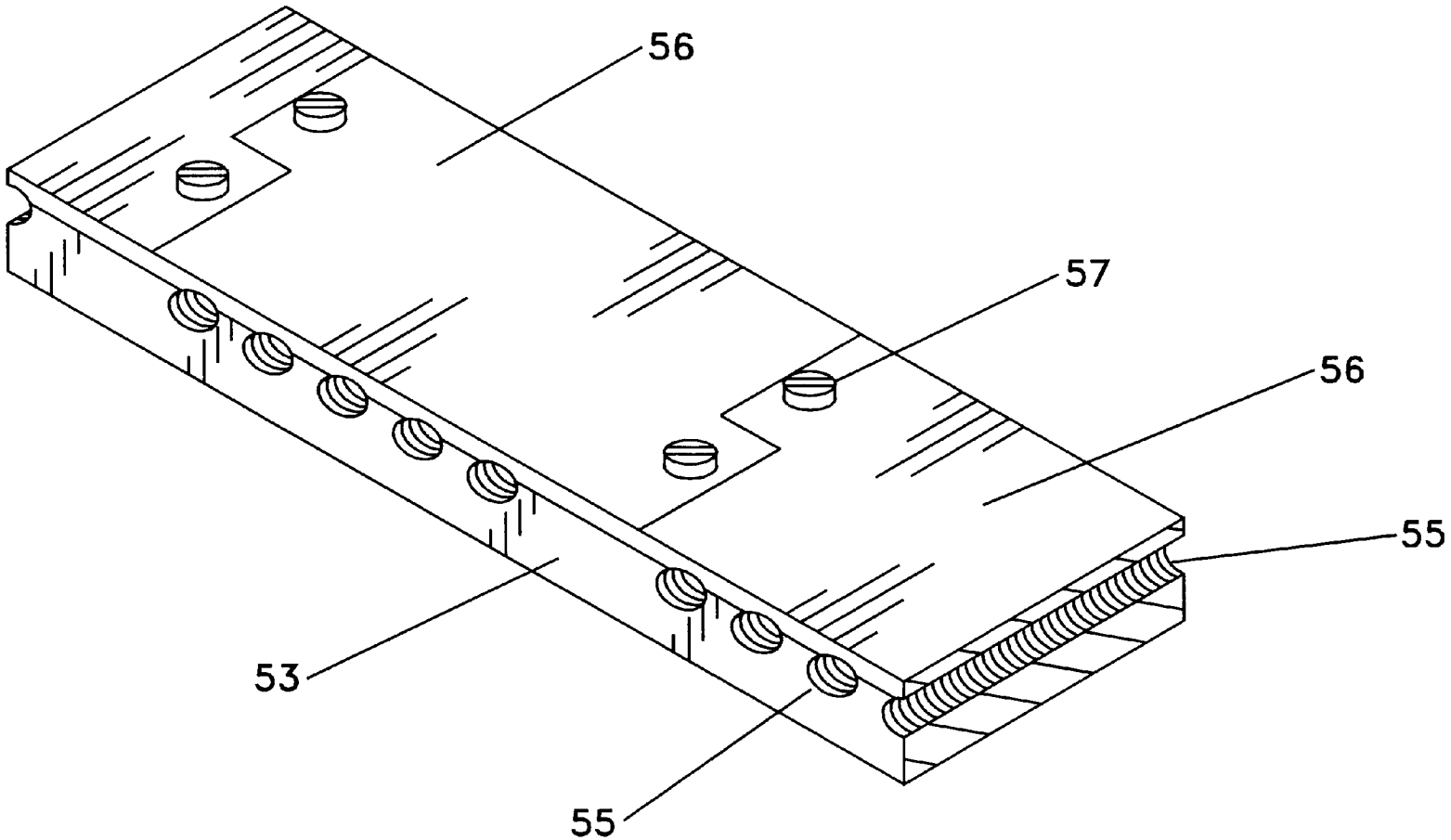
FIG. 6 is an enlarged partial view of the tube clamping means of FIG. 5.

FIG. 6 is a partial enlarged view of a tube mounting bracket to more clearly show the channel configuration. Each channel 55 is sized to receive a specific size of flexible tube and is provided with a roughened or grooved surface to more securely grip the tube without significant compression of the tube. The channels 55 lie primarily in base plate 53. The channels may be readily formed by drilling a plurality of holes in the base plate, machining one surface to expose the holes and form a plurality of open channels, attaching the cover plates 56 and tapping the holes to cut a series of threads in the channels and on the surface of the cover plates to provide tube gripping surfaces.

Due to the unique construction of the pump body in accordance with the present invention which provides an interior, free wheeling support roller in association with a plurality of circumferentially disposed, positively driven tube rollers, the construction of the pump assembly may be exceptionally wide, i.e., from about 15 to 25 inches or more, and can accommodate from about 40 to 80 or more flexible tubes while still providing reliable operation with constant and uniform pumping rates for all tubes.

While the preceding description has been directed to a specific preferred embodiment of the peristaltic pump of the present invention, many variations in materials and designs will be apparent to those skilled in the art and are included within the novel concepts of the present invention. The invention is accordingly not to be limited by the specific details described above.

That which is claimed is:

1. A peristaltic pump comprising a plurality of elongated tube rollers equally spaced and circumferentially disposed around and in surface contact with a central support roller, said support roller being rotatable about a central axis;

first and second tube roller supports rotatable about said central axis and having a plurality of bearing means for rotatably receiving each end of said elongated tube rollers;

drive means for rotating said first and second roller supports about said central axis whereby said tube rollers are caused to orbit said central support roller;

an arcuate backing plate spaced from said tube rollers a predetermined distance in order to close a compressible fluid delivery tube disposed between said tube rollers and said backing plate;

drive means for rotating each elongated tube roller about its own axis as said roller supports are rotated about the central axis whereby said tube rollers are caused to roll along said compressible fluid delivery tube disposed between said tube roller and said backing plate, and stationary end plates supporting a central drive shaft rotatable about said central axis.

2. A pump of claim 1 wherein said drive means for rotating each elongated tube roller about its own axis comprises a circumferential channel having inner and outer walls in a stationary end plate, one end of each tube roller extending through the roller support into said channel with the surface of the tube roller engaging the outer wall of the channel.

3. A pump of claim 2 wherein said outer wall of the channel is a ring gear and the end of each tube roller includes gear teeth for engaging said ring gear.

4. A pump of claim 1 including from two to six tube rollers.

5. A pump of claim 1 wherein said support roller is rotatably mounted on said drive shaft between said end plates.

6. A pump of claim 1 including a plurality of compressible fluid delivery tubes overlying said tube rollers between said tube rollers and said arcuate backing plate, said fluid delivery tubes being sufficiently compressed by said driven rollers to effectively close the inner lumen of said tubes.

7. A pump of claim 6 wherein said arcuate backing plate is spaced from the surface of said driven rollers by a distance equal to or less than twice the wall thickness of said compressible tubes.

8. A pump of claim 6 wherein said arcuate backing plate is spaced from the surface of said driven rollers by a distance of from about 1.4 to about twice the wall thickness of said compressible tubes.

9. A pump of claim 6 including tube clamping means for securing said plurality of compressible fluid delivery tubes on either side of said tube rollers and said backing plate.

10. A pump of claim 9 wherein said compressible fluid delivery tubes are maintained under tension between said tube clamping means.

11. A pump of claim 10 wherein said tension is obtained by stretching said compressible fluid delivery tubes from about 1 to 5 percent beyond their relaxed state.

12. A pump of claim 10 wherein said tube clamping means comprise a base plate and a cover plate, said base plate having a plurality of individual channels sized to receive said compressible fluid delivery tubes, said channels and said cover plate including a roughened surface for securely gripping said flexible tubes.

13. A pump of claim 12 wherein said roughened surface comprises radial grooves.

14. A method of simultaneously pumping fluids through a plurality of compressible fluid delivery tubes comprising the steps of:

mounting a plurality of fluid delivery tubes between an arcuate backing plate and a plurality of elongated tube rollers spaced from said backing plate a distance sufficient to close the lumen of each of said fluid delivery tubes in the area of contact with a respective one of said tube rollers, wherein the tube rollers are circumferentially disposed about a central axis and rotatable about said central axis, wherein each tube roller has at least one end with gear teeth circumferentially disposed therearound that matingly engage gear teeth of a stationary ring gear;

rotating said plurality of tube rollers in one direction about the central axis and along the length of said fluid delivery tubes adjacent said arcuate backing plate such that said stationary ring gear provides each tube roller with positive rotational drive that causes each individual tube roller to rotate in the opposite direction to said direction of rotation, whereby said tube rollers roll along the length of the fluid delivery tube independent of any frictional contact therewith; and providing a central support roller in contact with the longitudinal surface of each tube roller to prevent radial deflection of said tube rollers under the compressive forces of said fluid delivery tubes.

* * * * *